United States Patent [19]

Bost

[11] 4,323,099

[45] Apr. 6, 1982

[54] WOOD FINISHING MACHINE

[76] Inventor: Benjamin S. Bost, Box 321, Conover, N.C. 28613

[21] Appl. No.: 132,455

[22] Filed: Mar. 21, 1980

[51] Int. Cl.[3] ..... B27M 3/00; B27C 9/04

[52] U.S. Cl. ..... 144/3 R; 15/77; 51/80 R; 144/116

[58] Field of Search ..... 51/74 R, 80 R, 80 A, 51/81 R; 15/77, 102; 144/1 R, 3 R, 38, 116, 117 B

[56] References Cited

U.S. PATENT DOCUMENTS

| | | | |
|---|---|---|---|
| 497,979 | 5/1893 | Hayes | 144/38 |
| 1,857,832 | 5/1932 | Bailey | 51/80 A |
| 1,958,001 | 5/1934 | Heim | 51/80 A |
| 3,150,469 | 9/1964 | Berenbak et al. | 51/80 R |
| 3,326,252 | 6/1967 | Pease | 144/3 R |
| 3,503,161 | 3/1970 | Long | 51/80 R |
| 3,643,278 | 2/1972 | Harris et al. | 15/77 |
| 3,809,105 | 5/1974 | Horner | 15/77 |
| 3,895,464 | 7/1975 | Kiser | 144/116 X |
| 4,196,760 | 4/1980 | McDaniel et al. | 144/116 X |

*Primary Examiner*—W. D. Bray

*Attorney, Agent, or Firm*—Biebel, French & Nauman

[57] ABSTRACT

A wood finishing machine having a plurality of finishing devices, such as sanding wheels or the like, disposed on opposite sides of and above a horizontal table over which a workpiece is fed so as to be acted upon by each of the finishing devices. Each of the finishing devices is biased toward the passing workpiece and is free to ride on a contoured surface of the workpiece. A plurality of biased rollers are supported above the workpiece for maintaining it flat on the table of the machine as the workpiece passes among the finishing devices.

7 Claims, 8 Drawing Figures

WOOD FINISHING MACHINE

BACKGROUND OF THE INVENTION

1. Field of the Invention

The present invention relates to wood finishing equipment, and more particularly, to a wood finishing machine having multiple finishing wheels disposed at various locations along the length of the feed path of a contoured workpiece, which wheels are capable of following the contour of the workpiece as it passes among them.

2. Prior Art

Wood finishing techniques for preparation of wooden pieces for use in furniture and the like are very old and, for the most part, labor intensive. Such wood pieces are generally sanded or buffed by hand which, in more recent years, generally includes the use of a power driven finishing wheel which can be maneuvered over the workpiece by an individual to sand or buff the wood to the desired finish. This has always resulted in some inconsistency in the finish and variation in the depth to which the wood is removed to attain the finish and thus, can cause some distortion in appearance in the finished wood product. Much of the variation in finish is due to the inability of an individual to maintain a constant and uniform pressure on the finishing wheel as it moves over a contoured surface of a workpiece. In addition, it is very difficult to maintain the axis of rotation of the finishing wheel perpendicular to the surface of the workpiece which is being finished and thus the squareness of the workpiece is not easily maintained with the use of hand finishing methods.

SUMMARY OF THE INVENTION

The present invention overcomes the above described disadvantages and difficulties associated with the prior art devices as mentioned above, by providing an automatic wood finishing machine which applies constant pressure on the finishing devices which engage the workpiece for finishing it, and can maintain this constant pressure even over a contoured surface.

The wood finishing machine of the present invention comprises a frame structure supporting a stationary table and having an upper horizontal surface for supporting a moving workpiece thereon, first and second wood finishing means disposed on opposite sides of the path of movement of a workpiece over the table top, a third finishing means disposed above the upper surface of the workpiece for finishing the upper surface, means for biasing each of the finishing means against the surface of the workpiece on which it acts so as to maintain a uniform and constant pressure during the finishing operation, and means for feeding the workpiece over the upper surface of the table so that it passes among the three finishing means. The device also preferably includes means for engaging the upper surface of the workpiece to hold it firmly against the table top as it is moved between the various finishing means.

Each of the finishing means preferably includes a sanding or buffing wheel which is positioned adjacent the path of the workpiece and is biased against the workpiece to apply the proper finish thereto.

DETAILED DESCRIPTION OF THE PREFERRED EMBODIMENT

Figure 1:
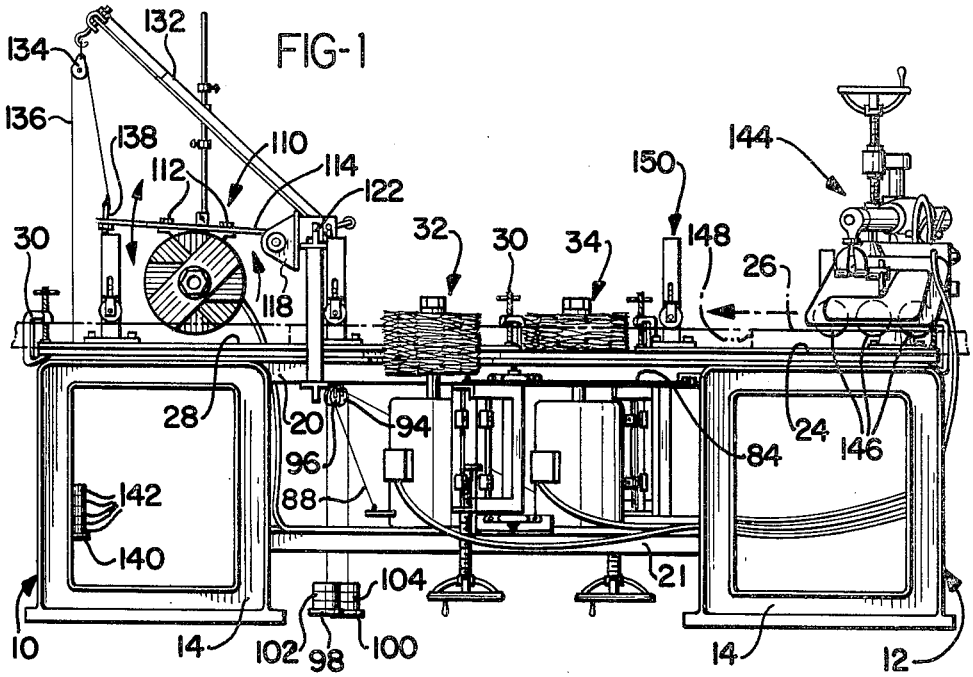
FIG. 1 is a front elevational view of the preferred embodiment of the present invention.

The main frame structure of the preferred embodiment of the present invention includes a pair of spaced end support frames 10 and 12, each of which has a pair of rectangular support legs 14 and 16 interconnected by a webbing 18 to provide a strong and stable base for the machine. End support frames 10 and 12 are interconnected by pairs of upper and lower spaced, parallel horizontally extending angle iron members 20, 21, 23 and 23 (23 is not shown) which are welded at each end to a respective steel support legs 14 and 16.

A table top 24 of contoured configuration is bolted to members 20 and 22 and extends horizontally over portions of the frame structure, with appropriate contour for receiving other parts of the machine as described in detail below. The table top 24 provides a flat horizontal surface in the area where a workpiece 26 is to be passed, and provides additional adjacent surfaces to which a guide rail 28 can be secured by a plurality of C-clamps 30 in order to provide a surface against which the workpiece 26 may be guided through the device. By using C-clamps 30, the guide rail can be easily repositioned for a variation in width of workpieces to be passed through the device, although other means for providing an adjustable guide rail could be utilized.

Figure 6:
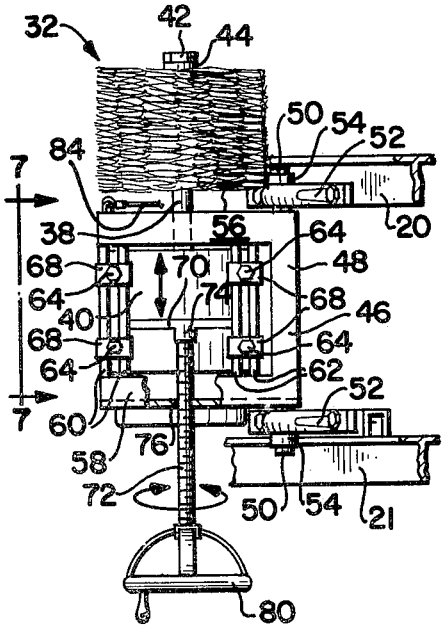
FIG. 6 is a view of one of the finishing heads of the preferred embodiment as seen in the direction of line 6—6 of FIG. 2.

Mounted on opposite sides of the path of movement of the workpiece 26 through the device, are a pair of first and second finishing means 32 and 34, respectively. Each of these finishing means is constructed essentially the same, and therefore only the first finishing means 32 will be described in detail in connection with FIGS. 6 and 7. As shown in FIG. 6, a finishing wheel 36 is supported on a vertically extending shaft 38 which is the drive shaft of an electric motor 40. Finishing wheels 36 are removably maintained on the shaft 38 by nut 42 and washer 44, for easy replacement of the wheels after they have become worn from use. Wheels 36 are illustrated as being sanding wheels fabricated of a plurality of layers of split edged sanding paper of a type which are commonly available. It is to be understood, however, that dependant upon the type of finish desired on the workpiece 26 being fed through the machine, numerous types of sanding and buffing wheels or the like can be substituted for the sanding wheels illustrated herein.

Drive motor 40 is of conventional construction with an appropriate rpm output for the type of finishing operation to be conducted, or can have its speed varied by conventional means if desired. Drive motor 40 is supported from a frame structure 46 which itself is pivotally mounted to the main frame structure members 20 and 21 as shown in FIG. 6. Frame member 46 is constructed with a main vertical support member 48 at each end of which is secured a pin 50 which extends through a corresponding bracket 52 containing a bushing 54 in which pin 50 is mounted for rotation. Brackets 52 are bolted to the respective member 20 and 21 as shown in FIG. 6.

Figure 7:
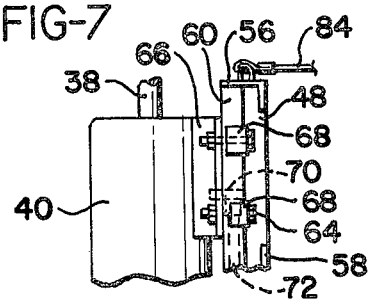
FIG. 7 is a partial view of the device showing the interconnection of the drive motor and support frame looking in the direction of line 7—7 of FIG. 6.

Also forming part of the frame member 46 are a pair of upper and lower horizontally extending frame members 56 and 58 which are welded at one end to the main vertical support member 48. Extending vertically between and welded to frame members 56 and 58 are two pairs of rectangular cross section metal bars 60 and 62 which form vertical slots between each pair. Four bolts 64 extend through these slots and through corresponding holes in a plate 66 securely mounted to the motor 40. A plurality of U-shaped clamps 68 which wrap around the bars 60 and 62, as shown in FIGS. 6 and 7, are held in position on the opposite side of the bars 60 and 62 from the plate 66 so that when the bolts 64 are tightened they will secure the motor rigidly to the frame member 46 for pivotal rotation therewith about pins 50.

Secured to the plate 66, such as by welding of the like, is a bracket 70 which extends horizontally between the pairs of bars 60 and 62 and preferably engages the innermost surfaces thereof to assist in alignment of the motor in a vertical direction. A threaded rod 72 has one end rotatably mounted in a cylindrical member 74 secured to bracket 70 and passes through a correspondingly threaded opening 76 defined in the lower frame member 58. The lower end portion of rod 72 is provided with a handle 80 for rotating the rod so that when the bolts 64 are loosened the motor can be moved vertically to adjust the position of wheel 36 relative to the side portion of a workpiece supported on the table top 24, in order that the wheel 36 completely and uniformly engages the surface of the workpiece.

As mentioned above, the second finishing means 34 is constructed essentially identical to the construction of the first finishing means 32 described immediately above, and is likewise pivotally secured to the opposite side of the same frame members 20 and 21.

Figure 2:
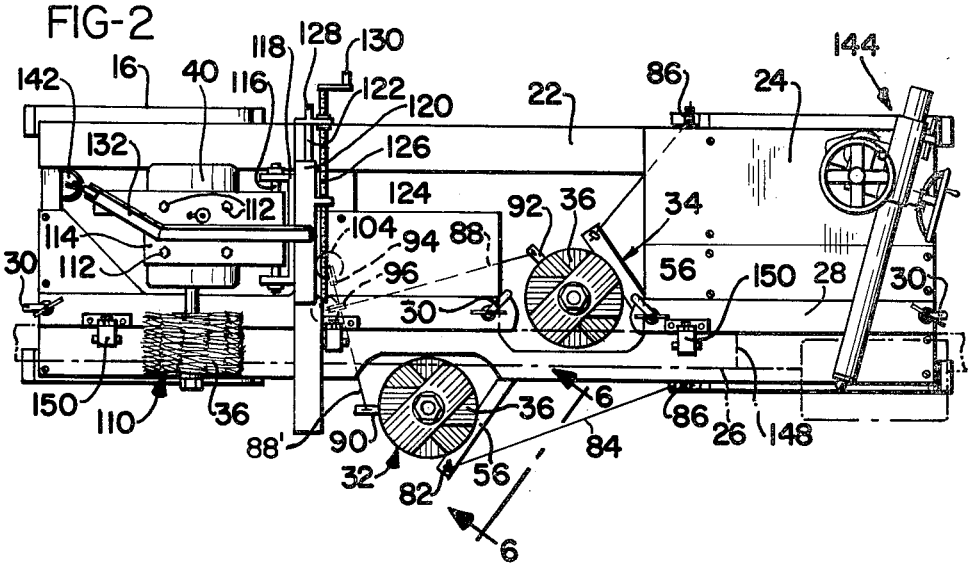
FIG. 2 is a plan view of the embodiment of FIG. 1.
Figure 3:
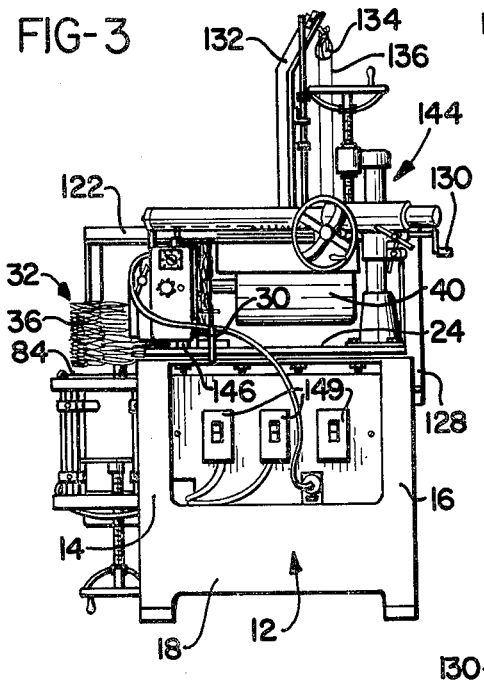
FIG. 3 is a right end view looking from right to left in FIG. 1.

As best seen in FIG. 2, each of the finishing means 32 and 34 is provided with a limit stop which prevents rotation of the respective frame members 46 toward the workpiece and the adjacent portion of the table top 24, mainly to prevent the finishing wheels 36 from resting against the adjacent portion of the table top when there is no workpiece positioned in the device, in order to prevent the wheels from acting on the table top and wearing it or the wheels down. This limiting means includes an eye 82 secured to the outer end portion of the frame members 56, a flexible wire 84 which has one end secured to the eye 82 and an opposite end secured to a length adjustment bracket 86 which can be tightened down onto the wire 84 at any desired position so that the stop limit of the inward movement of wheels 36 toward the workpiece can be adjusted to a desired position.

In order to bias the wheels 36 into engagement with the opposing side surfaces of the workpiece 26 as it passes over the table top 24, an adjustable weight and cable device is utilized so that a constant pressure can be maintained by the wheels 36 against the workpiece as the wheels pass over contoured portions of the workpiece and move inwardly and outwardly therefrom. This biasing means includes flexible wires 88 and 88' secured to corresponding brackets 90 and 92 on the sides of the motors 40 and which extend over corresponding pulleys 94 and 96 secured to the frame structure. Wires 86 and 88 then depend downwardly from the pulleys and have disc platforms 98 and 100 secured to the respective end portions thereof upon which a series of weights 102 and 104 can be applied to adjust the weight to any desired constant tension during rotation of the frame members 46 about their respective pivotal axis in order to maintain the finishing wheels 36 in engagement with the side portions of the workpiece.

Referring now to the third finishing means 110, it too includes a finishing wheel 36 mounted to a shaft 38 which is the drive shaft of an electrical motor 40, identical with those previously described. However, in the case of the third finishing means 110, the shaft 38 is disposed for rotation with its axis horizontal so that the finishing wheel 36 will engage the upper surface of the workpiece 26 as it passes thereunder.

The motor 40 is bolted with a plurality of bolts 112 to a plate 114 which is secured, such as by welding of the like, to a shaft 116 which in turn is pivotally mounted at its end portions in a U-shaped bracket 118. Bracket 118 is in turn secured to a laterally movable slide member 120 and rests on a cross beam 122 which is secured to the main frame structure of the machine. Attached to the side of slide member 120 is a bracket 124 which in turn is threadedly engaged with a threaded rod 126 mounted for rotation in a bushing on the side of a vertical beam 128 secured to the main frame structure. Attached to the outer end of the threaded rod 126 is a handle 130 which, upon rotation, causes lateral movement of the slide member 120 along the cross beam 122 in order to position the finishing wheel 36 of the third finishing means 110 properly above the upper surface of the workpiece 26.

A cantilevered beam 132 extends at an angle above the plate 114 and at its outermost end portion is secured a pulley 134. A flexible wire 136 extends over the pulley and has one end portion secured to an eye 138 bolted to the outer end portion of plate 114. The opposite end portion of wire 136 depends downwardly from the pulley 134 and has a disc 140 secured to the lower portion thereof to support a plurality of weights 142, the number and size of which can be adjusted to provide the proper degree of counterbalance for the weight of the motor 40, plate 114 and other parts of the third finishing means 110 which are supported by the wire 136 above the upper surface of table 24 and workpiece 26.

It is to be noted that since the weight of the motor and other parts supported by the wire 136 are acting downwardly to cause the wheel 36 of the third finishing means 110 to rest on the upper surface of the workpiece 26 with an inordinate amount of force, it is necessary to add sufficient weights 142 to counterbalance this weight and provide only a sufficient amount of downward force, or bias, on the wheel 36 to maintain the wheel in engagement with the upper surface of the workpiece 26 for the finishing action required.

At the opposite end of the machine from the third finishing means 110 is a feeding means 144. Feeding means 144 can be of any type which can engage the material and feed it through the device between the first and second finishing means and under the third finishing means 110. The device illustrated as feeding means 144 is a commercially available power feed unit which utilizes a plurality of compressible rollers 146 which engage the upper surface of the workpiece 26 and push it along the table towards the finishing means. The feeding means 144 is stationary during feeding and once a workpiece has passed the last roller in the direction of the finishing means, a next workpiece must be inserted which will butt against the rearmost edge portion of the previous workpiece as indicated at 148 so that the subsequent workpiece will force the previous workpiece to continue through the path of the finishing means.

Such a feeding means can be obtained, for example, from Festo Wood Working Machines, Port Washington, New York. The device preferably includes an adjustable feed control so that the speed of feeding workpieces through the machine can be adjusted for different finishing operations. Also, it is obviously necessary to provide means for adjusting the vertical and horizontal position of the feeding means in order to engage the different sizes and shapes of workpieces being fed through the machine. This mechanism is illustrated but will not be described further herein.

In operation, all of the motors 40 are initially started by turning switches 149, each of which controls a motor 40 to ON so that each of the finishing wheels 36 is operating before material is fed through the machine. The workpiece 26 is then passed under the feeding means 144 so that it is engaged thereby and will then be fed at the desired rate among the wheels 36 which will follow the contour of the workpiece. As mentioned above, as the end of the first workpiece passes under the last wheel of the feeder 44 a subsequent workpiece 26 must be engaged so that it will continue to push the first workpiece through the device. This operation is continued until all of the pieces have been finished. As can be noted, the bottom surface of the workpieces 26 will not be finished in this device. It is simple enough, however, to merely rotate the workpiece 180° and pass it through the device again in order to finish the bottom surface if this is desired. If in finishing the bottom surface of the workpiece it would be undesirable to further finish the sides of the workpiece, since it is taking a second pass through the machine, the first and second finishing wheels can be pulled away from the sides of the workpiece as it is passed through the device so that only the third finishing wheel in the third finishing means 110 will operate on the bottom surface of the workpieces 26 as they pass through the machine.

Figure 5A:
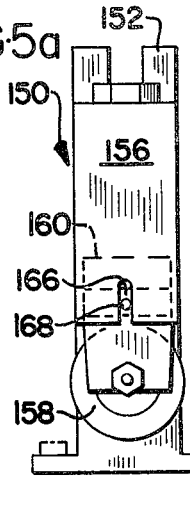
FIG. 5*a* is a front elevational view of a means for applying pressure to the upper surface of a workpiece, a plurality of which are illustrated in FIGS. 1 and 2.
Figure 5B:
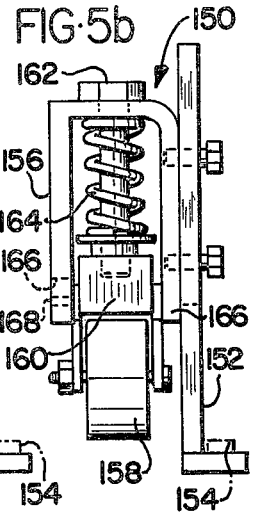
FIG. 5*b* is a side view of the device of FIG. 5*a;*
Figure 4:
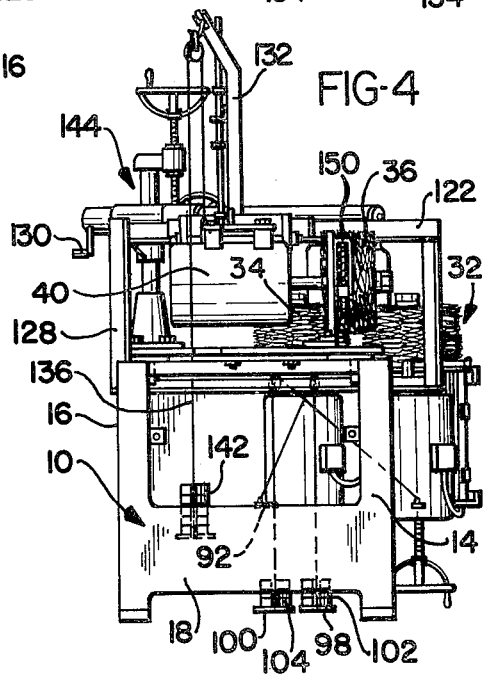
FIG. 4 is a left end view looking from left to right in FIG. 1.

Secured to the table top 24, or, as shown, to the guard rail 28, are a plurality of spring loaded pressure roller assemblies 150, as shown in more detail in FIGS. 5*a* and 5*b*, which are positioned in a plurality of locations along the length of the path the workpiece will move across the machine, as seen in FIGS. 1 and 2. Each of these pressure roller assemblies 150 includes an L-shaped bracket 152 which can be bolted at its lower end by bolts 154 to the table top 24 or guide rail 28, and which in turn has bolted thereto a U-shaped bracket 156. Bracket 156 carries the pressure roller 158 on a yoke member 160 so that the roller 158 is mounted for rotation. A bolt 162 extends through a hole in the upper surface of bracket 156 and has its lower end threaded into the yoke 160. A compression spring 164 is compressed between the inner surface of the bracket 156 and the upper surface of yoke 160 and compressed to the desired pressure level by tightening the bolt 162 to compress the spring 164. A pair of slotted openings 166 are formed on each side of the lower end portions of bracket 156 to provide guides for pins 168 secured to the yoke 160 so that the rollers 158 are restrained for vertical movement only. Thus, as the workpiece 26 passes under each of the subsequent pressure roller assemblies 150 it will be engaged by the rollers 158 and held against the upper surface of table top 24 as it passes through the machine so that it will not be deflected upwardly by action of the finishing wheels 36 on the workpieces.

Although the foregoing preferred embodiment has been described as having only three finishing means, it is to be understood that it is comtemplated that additional finishing means can be utilized wherein multiple types of finishing wheels can be used sequentially on each surface of a workpiece so that multiple steps can be accomplished on the machine as each workpiece passes therethrough. Further, it is contemplated that other means than the wire and weight arrangement for biasing each of the finishing wheels towards the workpiece can be utilized, such as for example, pneumatic or hydraulic systems which are constructed to maintain a constant and uniform pressure as the wheels pivot towards and away from the workpiece.

Although the foregoing illustrates the preferred embodiment of the present invention, other variations are possible. All such variations as would be obvious to one skilled in this art are intended to be included within the scope of the invention as defined by the following claims.

What is claimed is:

1. A wood finishing machine, comprising:

a frame structure;

a stationary table secured to said frame structure and having an upper horizontal surface for supporting a moving workpiece thereon;

first means for finishing a workpiece pivotally mounted to said frame structure for horizontal swinging movement towards and away from a side portion of a workpiece;

first means biasing said first finishing means against said side portion of a workpiece with constant force to follow the contour of said side portion of said workpiece;

second means for finishing a workpiece pivotally mounted to said frame structure for horizontal swinging movement towards and away from an opposite side portion of a workpiece than said first finishing means;

second means biasing said second finishing means against said opposite side of a workpiece with constant force and independently from said first biasing means to follow the contour of said opposite side portion of said workpiece;

third means for finishing a workpiece supported by said frame structure for vertical swinging movement towards and away from an upper surface of a workpiece;

third means biasing said third finishing means towards said upper surface of a workpiece with constant force and independently from said first and second biasing means to follow the contour of said upper surface of said workpiece; and means for feeding a workpiece over said upper surface of said table so as to pass by and be acted upon by each said finishing means.

2. A wood finishing machine as defined in claim 1, including:

means mounted to said table and engageable with said upper surface of a workpiece for holding a workpiece flat on said upper surface of said table as it is fed through said machine.

3. A wood finishing machine as defined in claim 2, wherein said means for holding a workpiece flat against the upper surface of the table includes a plurality of rollers supported for rotation about a horizontal axis, and means biasing said rollers into engagement with said upper surface of a workpiece.

4. A wood finishing machine as defined in claim 1 wherein said first, second and third means for finishing a workpiece each includes:

a finishing wheel disposed for rotation adjacent said respective surfaces of a workpiece;

drive means supporting each said wheel for rotation;

a frame member supporting each said wheel and said drive means and pivotally mounted to said frame structure for swinging movement toward and away from said respective surface of a workpiece; and means interconnecting said drive means with a respective said frame member for providing adjustment of the position of each said wheel relative to the respective said surface of a workpiece.

5. A wood finishing machine, comprising:

a frame structure;

a stationary table secured to said frame structure and having an upper horizontal surface for supporting a workpiece thereon;

a first means for finishing a workpiece, including:

a first finishing wheel disposed for rotation about a vertical axis adjacent a side portion of a workpiece, a first drive means supporting said first wheel and for causing rotation thereof, a first member supporting said first wheel and first drive means and pivotally mounted to said frame structure for swinging movement about a vertical axis so that said first wheel can move toward and away from said side portion of a workpiece, means interconnecting said first drive means and said first frame member for providing vertical adjustment of said first wheel relative to said side portion of a workpiece, and means engaging said first frame member for biasing said first wheel against said side portion of a workpiece with constant force to follow the contour of said side portion of the workpiece;

a second means for finishing a workpiece, including:

a second finishing wheel disposed for rotation about a vertical axis adjacent an opposite side portion of a workpiece from that of said first finishing means, a second drive means supporting said second wheel and for causing rotation thereof, a second frame member supporting said second wheel and second drive means and pivotally mounted to said frame structure for swinging movement about a vertical axis so that said second wheel can move toward and away from said opposite side portion of a workpiece, means interconnecting said second drive means and said second frame member for providing vertical adjustment of said second wheel relative to said opposite side portion of a workpiece, and means engaging said second frame member for biasing said second wheel against said opposite side portion of a workpiece with constant force and independently from said first biasing means to follow the contour of said opposite side portion of the workpiece;

a third means for finishing a workpiece, including:

a third finishing wheel disposed for rotation about a horizontal axis adjacent an upper surface of a workpiece;

a third drive means supporting said third wheel and for causing rotation thereof, a third frame member supporting said third wheel and third drive means and pivotally mounted to said frame structure for swinging movement about a horizontal axis so that said third wheel can move toward and away from said upper surface of a workpiece, means interconnecting said third drive means and said third frame member for providing horizontal adjustment of said third wheel relative to said upper surface of a workpiece, and means engaging said third frame member for biasing said third wheel against said upper surface of a workpiece with constant force and independently of said first and second biasing means to follow the contour of said upper surface of the workpiece; and means for feeding a workpiece over said upper surface of said table so as to pass by and be acted upon by each of said finishing means.

6. A wood finishing machine as defined in claim 5, including:

a plurality of rollers disposed in spaced relation above said upper surface of said table for engaging said upper surface of a workpiece, and means biasing said rollers into engagement with said upper surface of a workpiece.

7. A wood finishing machine as defined in claim 4 or 5, including:

adjustable limit stop means enaging said frame member supporting said first and second finishing means for limiting pivotal movement thereof towards the workpiece.

* * * * *